US008888960B2

(12) United States Patent
Kim

(10) Patent No.: US 8,888,960 B2
(45) Date of Patent: Nov. 18, 2014

(54) METHOD FOR COMPACTING COAL IN A MANNER SUITABLE FOR COKE OVEN CHAMBERS

(75) Inventor: Ronald Kim, Essen (DE)

(73) Assignee: Thyssenkrupp UHDE GmbH, Dortmund (DE)

( * ) Notice: Subject to any disclaimer, the term of this patent is extended or adjusted under 35 U.S.C. 154(b) by 737 days.

(21) Appl. No.: 13/138,583

(22) PCT Filed: Feb. 13, 2010

(86) PCT No.: PCT/EP2010/000897
§ 371 (c)(1),
(2), (4) Date: Nov. 9, 2011

(87) PCT Pub. No.: WO2010/102708
PCT Pub. Date: Sep. 16, 2010

(65) Prior Publication Data

US 2012/0055353 A1 Mar. 8, 2012

(30) Foreign Application Priority Data

Mar. 10, 2009 (DE) ..... 10 2009 011 927

(51) Int. Cl.
*C10B 53/00* (2006.01)
*C10B 45/02* (2006.01)
*C10B 31/10* (2006.01)

(52) U.S. Cl.
CPC ..... *C10B 45/02* (2013.01); *C10B 31/10* (2013.01)
USPC ..... 201/6; 201/8; 201/24; 201/40; 264/120; 44/591; 44/596; 44/620; 44/626

(58) Field of Classification Search
USPC ..... 201/6, 8, 24, 40; 264/120; 44/591, 596, 44/620, 626
See application file for complete search history.

(56) References Cited

U.S. PATENT DOCUMENTS

| | | | | |
|---|---|---|---|---|
| 4,318,779 | A * | 3/1982 | Tsuyuguchi et al. | 201/6 |
| 4,385,962 | A * | 5/1983 | Stewen et al. | 201/6 |
| 4,606,876 | A * | 8/1986 | Yoshida et al. | 264/120 |
| 6,059,932 | A * | 5/2000 | Sturgulewski | 202/262 |
| 6,773,500 | B1 | 8/2004 | Creamer et al. | |
| 7,497,930 | B2 * | 3/2009 | Barkdoll et al. | 201/41 |
| 7,815,829 | B2 * | 10/2010 | Schuecker | 264/148 |
| 8,105,516 | B2 * | 1/2012 | Fiedler et al. | 264/120 |
| 2007/0289861 | A1 * | 12/2007 | Barkdoll et al. | 201/8 |
| 2008/0087538 | A1 * | 4/2008 | Schuecker | 201/6 |
| 2009/0321980 | A1 * | 12/2009 | Fiedler et al. | 264/120 |

FOREIGN PATENT DOCUMENTS

| | | | |
|---|---|---|---|
| DE | 415 846 | C | 7/1925 |
| DE | 485 895 | C | 11/1929 |
| DE | 638 114 | C | 11/1936 |
| DE | 195 45 736 | A1 | 6/1997 |
| JP | 57-131282 | A | 8/1982 |
| JP | 59-076542 | U | 5/1984 |
| WO | WO 2006/056286 | A1 | 6/2006 |

OTHER PUBLICATIONS

Rex Wright, Franz-Josef Schuecker, and Ronald Kim; Compacting of Coal for Heat Recovery Ovens; Illawarra Coke Company. Pty Ltd, Coalcliffe, NSW, Australia; first presented at the 5th European Iron & Cokemaking Conference, Stockholm 2005; XP 002597325, Feb. 20, 2009.

* cited by examiner

*Primary Examiner* — Nina Bhat
(74) *Attorney, Agent, or Firm* — Marshall & Melhorn, LLC

(57) ABSTRACT

A method for compacting coal in a manner suitable for coke oven chambers is described. The coal is initially compressed by means of a suitable compressing device into one or more coal cakes, and the obtained coal cakes are divided into compacted products by a cutting device. The compacted products are stacked on top of the each other such that they can be loaded into a coke oven chamber for coking. The compacted products enable the coke oven chambers to be loaded in a precise and a coal loss-free manner. The coal compacted products are easy to store.

14 Claims, 1 Drawing Sheet

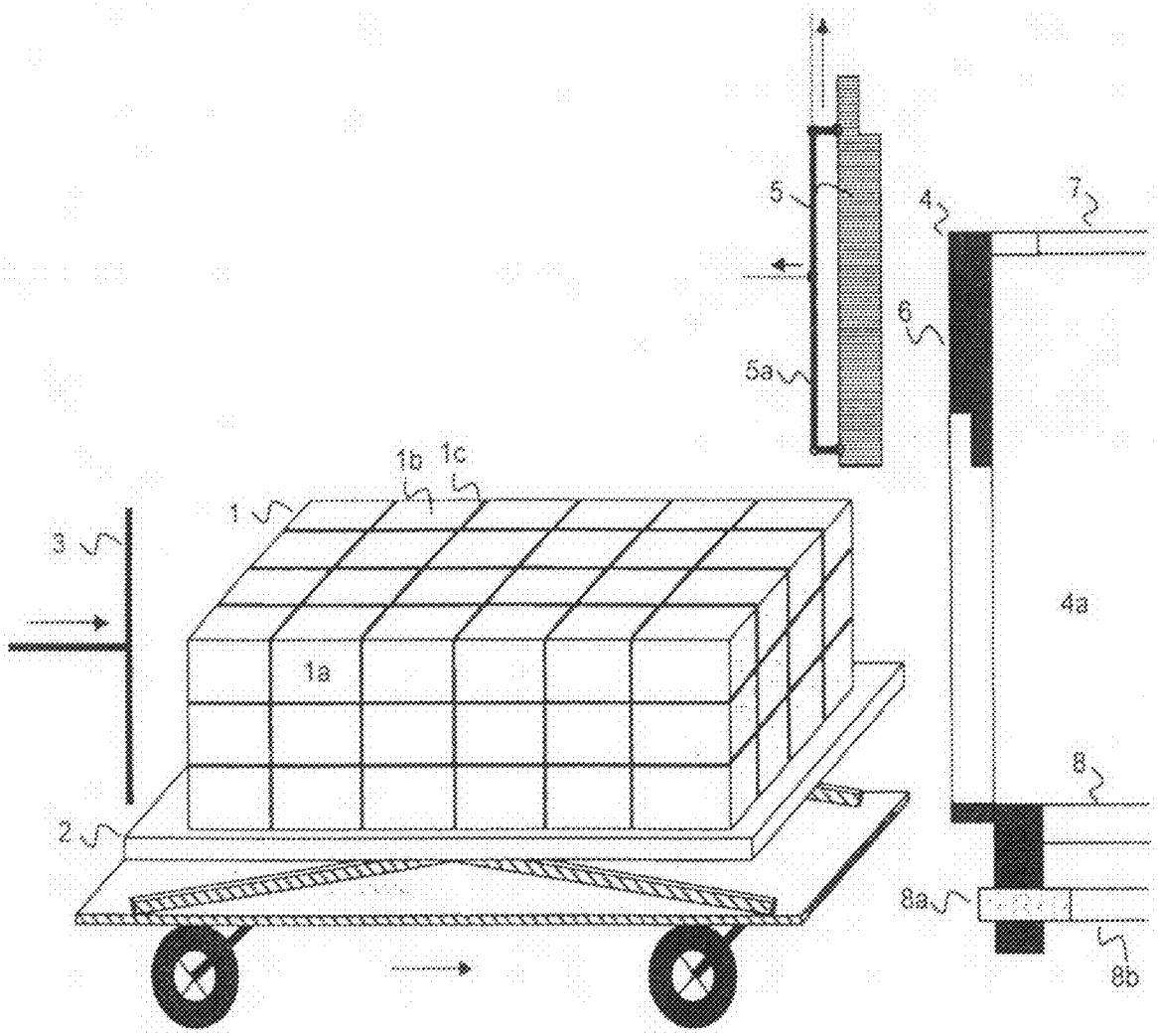
7
4
6
5
5a
4a
8
8a
8b
1
1a
1b
1c
3
2

METHOD FOR COMPACTING COAL IN A MANNER SUITABLE FOR COKE OVEN CHAMBERS

BACKGROUND OF THE INVENTION

The invention relates to a method for compacting of coal, wherein the compacts obtained represent blocks or enhanced lumps of pressed and compacted coal which can be charged into a coke oven chamber without incurring any loss of coal lumps. The invention also relates to the application of a method for production of coal compacts which serve for being charged into a horizontal coke oven chamber.

Charging of coke oven chambers can be accomplished in various ways. Some types of coke oven chambers are charged through their top which is advantageous for the design of coke oven doors and coke pusher machines. Charging is accomplished through special charging machines, which are mounted on the coke oven top, through charging apertures in the coke oven top. Cleaning of the coke oven top poses a difficult problem. Therefore, most design types for coke oven chambers are charged through coke oven chamber doors to be opened frontally, thus ensuring a substantially quicker and cleaner charging process. To this effect, doors through which the coke oven chamber can be charged and pushed empty are mounted at both front sides of a coke oven chamber. Typically installed at one side are the charging machines and coke quenching cars that can be traversed in front of the coke oven chambers along the frontal walls and which can be moved to the front of a coke oven chamber to initiate coal charging or coke quenching. Mounted on the other frontal side are coke pusher machines which can also be traversed in front of the coke oven chambers along the frontal walls and which can be moved to the front of a coke oven chamber to initiate coke pushing.

A customary design type for charging horizontal coke oven chambers is described in DE 19545736 A1. Coal is shed outside the oven at an even level onto a planar bottom plate and subsequently compacted, whereupon the compacted coal cake together with the bottom plate is gently pushed into the coke oven chamber, retracting the bottom plate subsequently from the oven chamber whilst the coal cake is retained at the front side. By way of these methods, it is possible to charge horizontal coke oven chambers, in particular, which are equipped with a floor heating. With this method, part of the coal gets lost because coal lumps of the compacted coal fall from the charging machine whilst charging. In the course of coal charging, coal lumps may also fall down in front of the coke oven chamber. Finally, a metered dosage of coal by applying this method is imprecise, because exactly allocated coal portions are not necessarily fed into the coke oven chamber.

DE 415846 C describes a method for the transfer of coal with poor caking properties into usable smelting coke by fine grinding and mixing of coal and subsequent briquetting. In contrast to the present application the compacts are produced in the desired size by pressing. In a subsequent process step a coal cake of the desired size is produced by the stacking of compacts.

Patent document "Compacting of coal for heat recovery ovens", Rex Wright, Franz-Josef Schücker, Ronald Kim, Internet: "www.coke-oven-managers.org", dated 19Aug., 2010, describes a method for compacting of coal of individually charged coal layers by hydraulically actuated compression plates from the top of the coal cake, wherein the coal cake is compacted by pressing of the coal cake in a compaction box. The method does not describe a division of the pressed coal cake obtained such that, if required, smaller coal compacts are obtained as well.

JP 57131282 A describes a method for grouping and stacking of coal compacts by grouping the coal compacts in one layer on a charging plate and turning the charging plate after stacking by a horizontal axis to allow vertical charging of the compact layer into the oven. The production of compacts is not described.

Utility model JP 5976542 U describes coal compacts which have a groove structure on the surface and may have channels in the inside for improving the carbonisation process. The production of compacts by dividing a pressed coal cake is not described.

Now, therefore, it is the object of the present invention to provide a method by means of which a coal cake is provided in precisely measured portions. It is also intended to provide a method that loads a coke oven chamber with the coal portions made available. This method is expected to have the advantage of avoiding an unintentional spreading of coal in the environment and providing coal envisaged for being carbonized in a coke oven chamber in exactly dimensioned portions.

The invention solves this task by pressing of coal, thus providing compacted portions of coal that are so dense that no or extremely few coal lumps get lost whilst transporting the coal portions. The coal compacts are produced by pressing in a suitable pressing machine, thus initially producing a large-size pressed cake, whereof coal compacts in the desired size can be furnished by applying suitable cutting tools. These coal compacts are stacked-up for coal carbonization and gently pushed with a charging machine or with another suitable device into the coke oven chamber.

Coal compacts can be pressed together with suitable moulded pieces during the pressing process so that bulges, depressions or wave shapes are created on the surface of coal compacts, thus affording the coal cake with improved coal carbonization properties. For example, substantially shortened coking times are thus achieved. The compacts can also be provided with intermediate layers so that a back-caking of compacts can be prevented. In this manner, substantially improved storage properties of the compacts are achieved, for example.

The invention relates to a method for coke oven chamber suitable compacting of coal by pressing and cutting of coal, wherein coal is pressed and compacted with a suitable pressing device into one or several coal blocks so as to obtain a dense and lump-free coal cake which is suitable for compacting of coal, and which is characterized in that the coal cake thus obtained is divided by a shearing device into compacts so as to obtain coal compacts intended for carbonisation in a coke oven chamber and provided in precisely sized portions.

In a preferred embodiment the coal compacts provided are charged individually or horizontally one beside the other or stacked one above the other or arranged horizontally one beside the other and stacked one above the other into a coke oven chamber to be loaded horizontally. In another embodiment of the invention the coal compacts obtained are charged by a charging machine into coke oven chambers to be loaded horizontally.

A coal cake is initially compacted in accordance with state-of-the art technology and then divided with a suitable cutting tool into the desired portions. Suitable cutting tools, for example, are metal blades or saw blades. These may have any arbitrary shape and be comprised of an arbitrary number of saw teeth. The cutting process can also be accomplished with a wire that has sufficient strength and thickness to cut the pressed coal cake. The wire, too, may be fabricated of any arbitrary material. For example, the metal blade, saw blade or the wire can be moved horizontally and vertically, for example with an hydraulic cutting device, and thus cut the pressed coal cake.

The cutting of blocks from a solid material by cutting tools is known. U.S. Pat. No. 6,773,500 B1 describes a concrete mix and a method for the production of aerated concrete building blocks by filling the concrete mix into moulds and curing it by the addition of an additive, thus obtaining a complete concrete building block which is subsequently cut by a suitable cutting tool into a suitable shape. An application of this method to a pressed coal cake is not described. The method described in the patent document is not applied to pressed material which is fabricated by pressing of particles. Therefore, as regards this teaching the person skilled in the art is not confronted with the problem of particle loss by damaging the pressed shape during the cutting operation.

In the present invention the pressing process, too, may be accomplished in any arbitrary manner. For example, it can be accomplished with a hydraulic press. But it may also be accomplished with a shaker machine by which the coal lumps are compacted into a sufficiently compacted shape. Finally, the pressing device may also be a hammering machine hammering against the press-on plates so that the coal cake is brought into a compacted shape. The coal cake can be laid onto a non-moving plate and be pressed laterally and from the top with suitable pressing devices. However, the coal cake can be pressed with any arbitrary device comprised of a moved plate from one side, from several sides or from all sides.

Press-on plates may have any arbitrary shape. They may be smooth or provided with appropriate shaping elements. Examples for shaping elements are wave moulds, thick needles or impression stingers. These take a shaping effect and leave depressions, wave shapes or bulges on the coal cake. For example, this is of essential advantage to achieve a shortening in coking time.

Coal compacts thus produced are brought into horizontal coke oven chambers that can be loaded frontally and that have an amply sized charging aperture. Coke oven chambers to be loaded are preferably of the ""Non-Recovery" or "Heat Recovery" type, although even conventional coke oven chambers and coke oven chambers to be charged horizontally can also be charged therewith.

Coal compacts thus received are stacked-up one above the other for charging in the coke oven chamber. This can be accomplished in any arbitrary number and stacking manner. Typical horizontal coke oven chambers are approx. 6 to 20 meter long, 6 to 10 meter tall and 0.5 to 5 meter wide. The number of compacts stacked-up one above the other and loaded into these ovens typically amounts to 5 to 30 in longitudinal direction, 1 to 10 in cross direction and 2 to 8 in height. The number and size of compacts, however, may also vary arbitrarily. The same applies to the size of the coke oven chambers to be loaded. The crucial point merely is that the compacts can be loaded into the coke oven chamber to be charged.

Finally, it is also feasible to interrupt the stacking of compacts by appropriate intermediate layers. Suitable intermediate layers, for example, are ash or paper leaving no residues when burnt. In this manner, a back-caking of compacts can be prevented even in case of an extensive storage period. Upon completion of the storage period or coal carbonization, the ash is removed, for example, by blowing it away. Upon coal carbonization, one receives a usual coke cake that can be further processed with normal state-of-the art processes.

Coal compacts thus received are preferably charged with a charging machine into coke oven chambers to be loaded horizontally. An example for a charging method with a charging machine is taught by DE 19545736 A1. However, any charging method by way of which coal compacts can be transported into the coke oven chamber is suitable. This may also be a charging machine that has been modified to suit requirements or even a fork-lift truck in a simply design type.

The inventive method provides the benefit of providing coal compacts that can be loaded into coke oven chambers without incurring any loss of coal. Loading is accomplished portion-wise and in a quantity that can be precisely and simply computed with a defined portion size. Production of compacts is simple. If a suitable intermediate layer is applied, the compacts attain excellent capability of storage.

BRIEF DESCRIPTION OF THE DRAWING

The inventive device is elucidated by way of a drawing, with this drawing just representing examples of embodiments for the design of the inventive device.

The FIGURE shows a coal cake subdivided into compacts for delivery into a coke oven.

DETAILED DESCRIPTION OF THE INVENTION

Shown here is the coal cake (1) that has been divided with a cutting device into a number of compacts. The compacts (1*a*, 1*b*) here are to be seen at the front side (1*a*) and from the upper side (1*b*) of the coal cake (1), said compacts being separated from each other by a cut interface (1*c*). The actual coal cake (1) here can be seen on a mobile car (2). It is gently pushed by a pushing device (3) into the coke oven chamber (4*a*). It is to be seen here in opened status. One can also see the coke oven chamber (4), the coke oven chamber door (5) with the opening mechanism (5*a*), the wall (6) encompassing the coke oven chamber door, part of the coke oven chamber top (7) and part of the coke oven chamber floor (8) with the opening ports (8*a*) for secondary air soles (8*b*).

LIST OF REFERENCE SYMBOLS

1 Coal cake
1*a* Coal compact to be seen from the front side of the coal cake
1*b* Coal compact to be seen from the upper side of the coal cake
1*c* Cut interface in coal cake
2 Mobile car
3 Pushing device
4 Coke oven chamber
4*a* Coke oven chamber (interior of the coke oven chamber
5 Coke oven chamber door
5*a* Opening mechanism for the coke oven chamber door
6 Coke oven chamber wall
7 Top of the coke oven chamber
8 Coke oven chamber floor
8*a* Opening ports for secondary air soles
8*b* Secondary air soles

The invention claimed is:

1. A method for compacting coal suitable for a coke oven chamber by pressing of coal, wherein:

coal is pressed and compacted with a suitable pressing device into one or several coal blocks so as to obtain a dense and lump-free coal cake which is suitable for compacting of coal; and the coal cake thus obtained is divided by a shearing device into compacts so as to obtain coal compacts intended for carbonization in a coke oven chamber and provided in precisely sized portions.

2. The method for compacting coal by pressing according to claim 1, wherein the coal compacts are charged individually or horizontally one beside the other or stacked one above the other or arranged horizontally one beside the other and stacked one above the other into a coke oven chamber to be loaded horizontally.

3. The method for compacting of coal suitable for coke oven chambers by pressing according to claim 1, wherein the coal compacts obtained are charged by a charging machine into coke oven chambers to be loaded horizontally.

4. The method for coke oven chamber suitable compacting of coal by pressing as defined in claim 1, wherein the shearing device is a metal blade or a saw blade.

5. The method for coke oven chamber suitable compacting of coal by pressing as defined in claim 1, wherein the shearing device is a wire.

6. The method for coke oven chamber suitable compacting of coal by pressing as defined in claim 1, wherein the pressing device is a hydraulic press.

7. The method for coke oven chamber suitable compacting of coal by pressing as defined in claim 1, wherein the pressing device is a shaker machine by means of which the coal lumps are compacted in terms of their packing density.

8. The method for coke oven chamber suitable compacting of coal by pressing as defined in claim 1, wherein the pressing device is a hammering machine comprised of press-on plates.

9. The method for coke oven chamber suitable compacting of coal by pressing as defined in claim 3, wherein the pressing device is a device that is comprised of one or more press-on plates with acutely ending impression stingers.

10. The method for coke oven chamber suitable compacting of coal by pressing as defined in claim 1, wherein the compacts obtained are stacked-up one above the other.

11. The method for coke oven chamber suitable compacting of coal by pressing as defined in claim 10, wherein the compacts obtained are stacked-up one above the other, with a layer of ash being laid between the individual compacts.

12. The method for coke oven chamber suitable compacting of coal by pressing as defined in claim 10, wherein the compacts obtained are stacked-up one above the other, with a layer of paper leaving no residues when burnt being laid between the individual compacts.

13. A method for loading of coke oven chambers by use of coal compacts, produced by utilizing the method of claim 1, comprising bringing the coal compacts obtained into a horizontal Non-Recovery or Heat Recovery coke oven chamber.

14. A method for loading of coke oven chambers by use of coal compacts, produced by utilizing the method as defined in claim 1, comprising bringing the coal compacts obtained into a horizontal coke oven chamber in a number of 5 to 30 in longitudinal direction, 1 to 10 in cross direction, and 2 to 8 stacked-up one above the other.

* * * * *